US008881773B2

(12) United States Patent
Miller et al.

(10) Patent No.: US 8,881,773 B2
(45) Date of Patent: Nov. 11, 2014

(54) APPARATUS FOR REMOVAL OF LOOSEFILL INSULATION

(75) Inventors: Carla Miller, Newark, OH (US); Jason S. Fokens, New Albany, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 585 days.

(21) Appl. No.: 12/955,295

(22) Filed: Nov. 29, 2010

(65) Prior Publication Data

US 2011/0126937 A1 Jun. 2, 2011

Related U.S. Application Data

(60) Provisional application No. 61/264,945, filed on Nov. 30, 2009.

(51) Int. Cl.

| | |
|---|---|
| ***B65B 1/20*** | (2006.01) |
| ***B08B 5/04*** | (2006.01) |
| ***A47L 7/00*** | (2006.01) |
| ***E04F 21/08*** | (2006.01) |

(52) U.S. Cl.

CPC ..... *E04F 21/085* (2013.01); *B08B 5/04* (2013.01); *A47L 7/0071* (2013.01)

USPC ..... 141/12; 141/73; 141/98; 141/231; 406/38; 406/135; 406/197

(58) Field of Classification Search

CPC ..... E04F 21/085; B05B 7/1409; B05B 7/145; B05B 15/0406; B05B 15/0412; A47L 7/0071; A47L 7/0085

USPC ..... 141/1, 12, 73, 98, 231; 406/38–39, 197, 406/52, 135

See application file for complete search history.

(56) References Cited

U.S. PATENT DOCUMENTS

| | | | |
|---|---|---|---|
| 4,179,043 | A | 12/1979 | Fischer |
| 4,337,902 | A | 7/1982 | Markham |
| 4,344,580 | A | 8/1982 | Hoshall et al. |
| 4,381,082 | A | 4/1983 | Elliott et al. |

(Continued)

FOREIGN PATENT DOCUMENTS

| | | | |
|---|---|---|---|
| EP | 0653178 | A1 | 5/1995 |
| WO | 200006816 | A1 | 2/2000 |

OTHER PUBLICATIONS

Robert Whittle, "Roof Insulation Vacuum for Removal of Old Roof Waste," Aug. 13, 2009, Retrieved from the Internet: URL: http://www.youtube.com/watch?v=o0Ghd1SBzg8 [retrieved Jan. 28, 2013]. This Internet citation is a YouTube movie posted Aug. 13, 2009. The annexed print-out is a general overview of the apparatus shown in this movie.

(Continued)

*Primary Examiner* — Timothy L Maust
*Assistant Examiner* — Timothy P Kelly
(74) *Attorney, Agent, or Firm* — Fraser Clemens Martin & Miller LLC; Charles F. Charpie

(57) ABSTRACT

An apparatus configured to facilitate removal of existing, previously-applied loosefill insulation material from a building cavity is provided. The apparatus includes a removal hose configured for conveying the removed loosefill insulation material and an actuator connected to the removal hose. The actuator is configured to generate a removal force configured to remove the loosefill insulation material from the building cavity. A receptacle is connected to the actuator and configured for storage of the removed loosefill insulation material. The removed loosefill insulation material is configured for reuse as loosefill insulation material within the building cavity.

17 Claims, 6 Drawing Sheets

(56) References Cited

U.S. PATENT DOCUMENTS

| | | | | |
|---|---|---|---|---|
| 4,389,931 | A * | 6/1983 | Sutter | 100/90 |
| 4,716,712 | A | 1/1988 | Gill | |
| 4,829,738 | A | 5/1989 | Moss | |
| 5,259,425 | A * | 11/1993 | Johnson et al. | 141/12 |
| 5,403,128 | A * | 4/1995 | Thomas | 406/39 |
| 5,511,730 | A | 4/1996 | Miller et al. | |
| 6,045,298 | A * | 4/2000 | Lytle | 406/48 |
| 6,371,148 | B1 | 4/2002 | Tripp | |
| 6,401,757 | B1 | 6/2002 | Pentz et al. | |
| 6,451,078 | B2 * | 9/2002 | Berfield et al. | 55/374 |
| 6,732,960 | B2 | 5/2004 | Shaw et al. | |
| 7,354,466 | B2 | 4/2008 | Dunning et al. | |
| 7,971,813 | B2 * | 7/2011 | O'Leary et al. | 241/60 |
| 2007/0246118 | A1 | 10/2007 | Wagner et al. | |
| 2008/0087751 | A1 | 4/2008 | Johnson et al. | |
| 2008/0087752 | A1 * | 4/2008 | Johnson et al. | 241/80 |

OTHER PUBLICATIONS

Robert Whittle, "Vac N Sack—Roof Insulation Vacuum," Jul. 12, 2009, Retrieved from the Internet: URL: http://www.youtube.com/watch?feature=player_detailpage&v3fALcBe4j4l [retrieved Jan. 28, 2013]. This Internet citation is a YouTube movie posted Jul. 12, 2009. The annexed print-out is a general overview of the apparatus shown in this movie.

Robert Whittle, "Roof Insulation Vac N Sack Vacuum System," Jul. 22, 2009, Retrieved from the Internet: URL: http://www.youtube.com/watch?v=RZ3NTRbdKdo&list=UUOghofpUxDaQYhuVJzmTslA&index=11 [retrieved Jan. 28, 2013]. This Internet citation is a YouTube movie posted Jul. 2, 2009. The annexed print-out is a general overview of the apparatus shown in this movie.

"Insulation and Dust Vacuum Trailer System," Mar. 25, 2010, Retrieved from the Internet: URL:http://www.vacteck.com/products/vacuum-trailers/insulation-vacuum-dust-loose-fill-and-all-cool-n-cozy-insultaion-vacuum.html [retrieved on Jan. 28, 2013].

"Air Powered Vacuum," Retrieved from the Internet: URL: http://www.drum-vac.com/images/stories/2013/Drum%20Top%20Vac-Spillmaster%20sales%20brochure-prices.pdf [retrieved on Jan. 29, 2013].

* cited by examiner

APPARATUS FOR REMOVAL OF LOOSEFILL INSULATION

RELATED APPLICATIONS

This application claims the benefit of pending U.S. Provisional Patent Application No. 61/264,945, filed Nov. 30, 2009, the disclosure of which is incorporated herein by reference.

BACKGROUND

Various insulative materials or combinations of insulative materials can be used to insulate buildings. Some of the insulative materials include spray foams, loosefill insulation, and batts of fibrous insulation.

Spray foam insulation can include materials that are mixed at the building site and applied with a sprayer. The sprayer can be configured to introduce the spray foam insulation into joints, cavities, and penetrations of the building ceilings, floors and walls. After setting, the spray foam insulation can be effective in reducing air infiltration into the building. Spray foam insulation can be used in combination with subsequently installed insulative materials such as loosefill insulation and batts of fibrous insulation.

In contrast to spray foam insulation, loosefill insulation material includes a multiplicity of discrete, individual tufts, cubes, flakes or nodules. Loosefill insulation material can be applied to buildings by blowing the loosefill insulation material into insulation cavities, such as sidewall cavities or an attic of a building. Loosefill insulation material can be made from glass fibers, although other mineral fibers, organic fibers, and cellulose fibers can be used. The distribution of the loosefill insulation material into an insulation cavity typically uses a blowing wool distribution machine that conditions the loosefill insulation material and feeds the conditioned loosefill insulation material pneumatically through a distribution hose.

In addition to application of the spray foam insulation during construction of new buildings, it may be desirable to retrofit existing buildings with spray foam insulation. In these situations, existing previously-applied insulative materials, such as for example loosefill insulation, may need to be removed prior to installation of the spray form insulation.

It would be advantageous if existing, previously-applied loosefill insulation material could be easily removed from a building.

SUMMARY OF THE INVENTION

The above objects as well as other objects not specifically enumerated are achieved by an apparatus configured to facilitate removal of existing, previously-applied loosefill insulation material from a building cavity. The apparatus includes a removal hose configured for conveying the removed loosefill insulation material and an actuator connected to the removal hose. The actuator is configured to generate a removal force configured to remove the loosefill insulation material from the building cavity. A receptacle is connected to the actuator and configured for storage of the removed loosefill insulation material. The removed loosefill insulation material is configured for reuse as loosefill insulation material within the building cavity.

According to this invention there is also provided a method of removing existing, previously-applied loosefill insulation material from a building cavity and reapplying the loosefill insulation material into the building cavity. The method includes the steps of providing an apparatus configured to facilitate removal of existing, previously-applied loosefill insulation material from a building cavity, the apparatus including a removal hose configured for conveying the removed loosefill insulation material, an actuator connected to the removal hose and configured to generate a removal force to remove the loosefill insulation material from the building cavity and a receptacle connected to the actuator, the receptacle configured for storage of the removed loosefill insulation material, withdrawing the existing, previously-applied loosefill insulation material through the removal hose of the apparatus, configuring the withdrawn loosefill insulation material for reuse as loosefill insulation using the apparatus and reapplying the withdrawn loosefill insulation material into the building cavity using the apparatus.

According to this invention there is also provided an apparatus configured for conditioning batts of insulation as loosefill insulation material. The apparatus includes a lower unit having a plurality of shredders. The shredders are configured to shred, pick apart and condition the batts of insulation as loosefill insulation material. A receptacle is connected to the lower unit. The receptacle is configured for storage of the conditioned loosefill insulation material.

Various objects and advantages of this invention will become apparent to those skilled in the art from the following detailed description of the various embodiments, when read in light of the accompanying drawings.

DETAILED DESCRIPTION OF THE INVENTION

Figure 1:
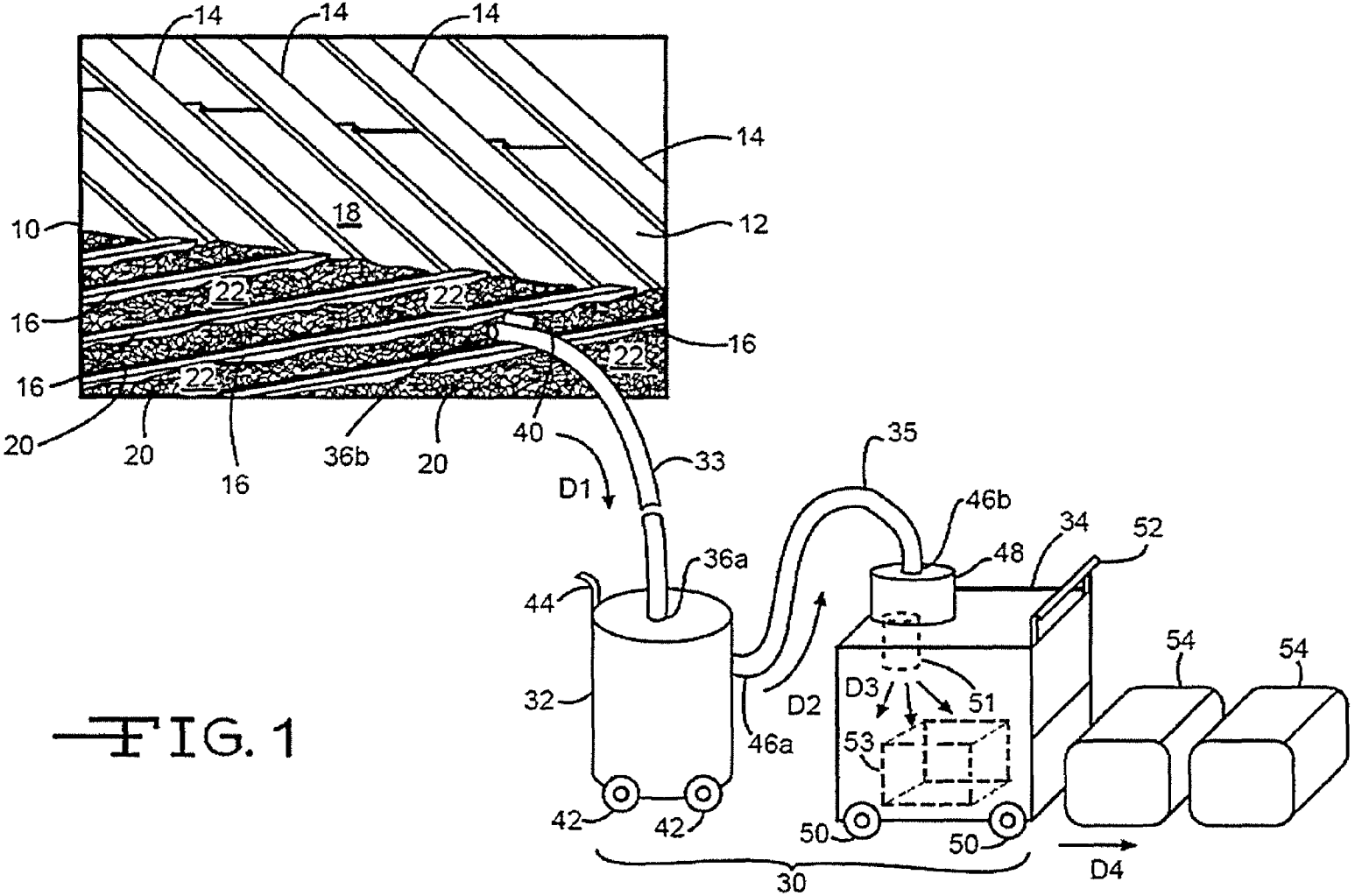
FIG. 1 is a schematic view of an apparatus configured to facilitate removal of existing, previously-applied loosefill insulation material from insulation cavities of a building.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose an apparatus configured to facilitate removal of existing, previously-applied loosefill insulation material from insulation cavities. The insulation cavities can be any insulated space within the building, including the non-limiting examples of a building attic or sidewalls. Generally, the apparatus uses a vacuum force to remove the existing loosefill insulation material. Optionally, the apparatus can include storage and processing capacity for the removed loosefill insulation material, such that the removed loosefill insulation material can be subsequently redistributed into insulation cavities.

As discussed above, existing buildings can be insulated with loosefill insulation material. The loosefill insulation material can be distributed or blown into building insulation cavities by a blowing wool machine. The blowing wool machine is configured to "condition" the loosefill insulation material prior to distribution into the insulation cavities. The term "condition" as used herein, is defined to mean the shredding of the loosefill insulation material to a desired density prior to distribution into an airstream. Blowing wool machines can include various mechanisms or combinations of mechanisms, such as for example shredders, beater bars and agitators for final shredding of the loosefill insulation material prior to distribution. Once conditioned, the loosefill insulation material can be distributed pneumatically through a distribution hose.

In the event it is desired to retrofit existing buildings previously insulated with loosefill insulation material with other insulation materials, such as for example spray foam insulation, it may be desirable to remove the existing previously-applied loosefill insulation material prior to the application of the spray foam insulation. In some instances, the existing loosefill insulation material may be discarded during the removal process. In other instances, it may be desired to reuse the removed loosefill insulation material.

Referring now to FIG. 1, a building is illustrated generally at 10. The building 10 includes a roof deck 12 supported by a plurality of rafters 14 and an internal ceiling (not shown) supported by a plurality of framing members 16. An attic space 18 is formed internal to the building 10 and defined by the roof deck 12 and the framing members 16. Insulation cavities 20 are formed between the plurality of framing members 16. The insulation cavities 20 can be filled with loosefill insulation material 22. While the insulation cavities 20 illustrated in FIG. 1 are shown as being located in the attic space 18 of the building 10, it should be appreciated that other insulation cavities, filled with loosefill insulation material, can occur in other locations of the building 10, such as for example within sidewalls.

Referring again to FIG. 1, an apparatus 30 configured for removal of the loosefill insulation material 22 from the insulation cavities 20 is illustrated. The apparatus 30 includes an actuator 32, a removal hose 33, at least one receptacle 34 and a connector 35 configured to connect the actuator 32 with the receptacle 34.

The actuator 32 is configured to generate a removal force, transmitted through the removal hose 33, to the loosefill insulation material 22. The removal force is configured to withdraw the loosefill insulation material 22 from the insulation cavities 20 and convey, in the direction indicated by arrow D1, the withdrawn loosefill insulation material 22 to the actuator 32. In one embodiment, the removal force is a pneumatic vacuum force. In other embodiments, the removal force can be other desired forms.

In the illustrated embodiment, the actuator 32 is configured to be positioned in a space that is external to the building 10. However, the actuator 32 can be positioned in other desired locations within the interior of the building 10. A first end 36*a* of the removal hose 33 is connected to the actuator 32 and a second end 36*b* of the removal hose 33 is positioned in the insulation cavities 20. In the illustrated embodiment, the removal hose 33 is a flexible hose having a diameter of approximately 3.0 inches and a length of approximately 100 feet. In other embodiments, the removal hose 33 can have a diameter of more or less than approximately 3.0 inches and a length of more or less than approximately 100 feet. In some embodiments, the removal hose 33 can be internally lined with a low-friction surface material or coating, such as for example Teflon®, configured to facilitate passage of the removed loosefill insulation material through the removal hose 33.

In the illustrated embodiment, an optional controller 40 is positioned near the second end 36*b* of the removal hose 33. The controller 40 is configured to control the operation of the actuator 32, such as for example on, off and flow rate. In the illustrated embodiment, the controller 40 is configured for wireless communication with the actuator 32. However, the controller 40 can also be configured for wired communication with the actuator 32.

Optionally, the actuator 32 can include a plurality of wheels 42 and at least one handle 44. The wheels 42 and the handle 44 are configured to facilitate easy movement of the actuator 32 from one location to another. However, the wheels 42 and the handle 44 are not necessary to the operation of the apparatus 30.

In operation, the actuator 32 is configured to convey the removed loosefill insulation material through the removal hose 33, through the connector 35, in direction indicated by arrow D2, and into the receptacle 34. The connector 35 has a first end 46*a* attached to the actuator 32 and a second end 46*b* attached to the receptacle 34. In the illustrated embodiment, the connector 35 is the same as, or similar to, the removal hose 33 shown in FIG. 1 and discussed above. However, the connector 35 can be different from the removal hose 33.

Referring again to FIG. 1, the receptacle 34 includes an optional compacting mechanism 48. The compacting mechanism 48 is configured to compress the withdrawn loosefill insulation material to a desired compression ratio thereby facilitating storage of the withdrawn loosefill insulation material. The compacting mechanism 48 can be any desired structure, mechanism or device sufficient to compress the withdrawn loosefill insulation material to a desired compression ratio. After compaction, the compressed loosefill insulation material is conveyed in the direction indicated by arrow D3, within the receptacle 34. In the illustrated embodiment, the withdrawn loosefill insulation material is compressed by the compacting mechanism 48 to a compression ratio in a range of from about 5:1 to about 10:1. In other embodiments, the withdrawn loosefill insulation material can be compressed by the compacting mechanism 48 to a compression ratio of less than about 5:1 or more than about 10:1. The receptacle 34 can be made of any desired material and have any desired shape and size.

Optionally, the receptacle 34 can include an air separation mechanism 51. The air separation mechanism 51 is configured to separate or filter the withdrawn loosefill insulation material from the removal force. In one embodiment, the air separation mechanism 51 can be a rotary valve. In other embodiments, the air separation mechanism 51 can be other structures, mechanisms or devices, such as the non-limiting example of a filter, sufficient to separate or filter the withdrawn loosefill insulation material from the removal force.

Optionally, the receptacle 34 can include a plurality of wheels 50 and at least one handle 52. The wheels 50 and the handle 52 are configured to facilitate easy movement of the receptacle 34 from one location to another. However, the wheels 50 and the handle 52 are not necessary to the operation of the apparatus 30.

Optionally, the receptacle 34 can include a packaging mechanism 53. The packaging mechanism 53 can be configured to encapsulate the compressed withdrawn loosefill insulation material into a bag, thereby forming a bag of compressed loosefill insulation 54. In the illustrated embodiment, the bags 54 are made of polymeric material, such as for example polypropylene. However, the bags 54 can be made from other suitable material. During the packaging of the compressed loosefill insulation material, the loosefill insulation material remains under compression for storage and transportation efficiencies. The bags 54 exit the receptacle 34 in the direction as indicated by arrow D4.

In operation, the loosefill insulation material 22 is removed from the insulation cavities 20 as discussed above. After the loosefill insulation material 22 is removed, the exposed joints, cavities, and building penetrations can be insulated using other insulation materials, such as for example, spray insulation. After the spray insulation sets, new loosefill insulation material or the withdrawn loosefill insulation material can be reused and distributed into the insulation cavities 20 by a suitable blowing wool machine (not shown).

Figure 2:
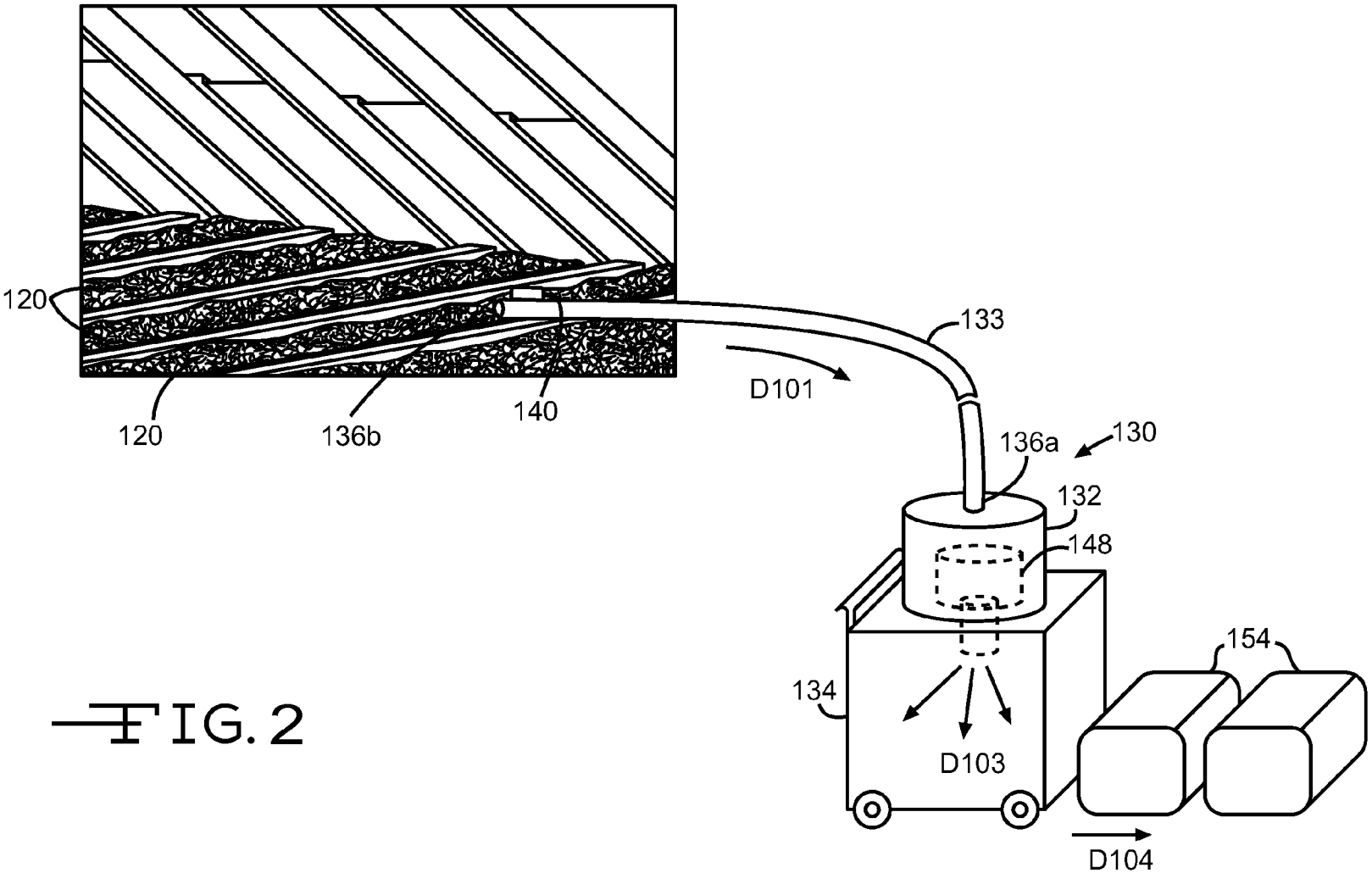
FIG. 2 is a schematic view of a second embodiment of an apparatus configured to facilitate removal of existing, previously-applied loosefill insulation material from insulation cavities of a building.

While the apparatus 30, illustrated in FIG. 1 and discussed above includes separate components for the actuator 32 and the receptacle 34, other embodiments can combine the actuator 32 and the receptacle 34 into a single apparatus. Referring now to FIG. 2, an apparatus 130, including both an actuator 132 and a receptacle 134, is illustrated. In the illustrated embodiment, the actuator 132 and the receptacle 134 are the same as, or similar to, the actuator 32 and the receptacle 34 illustrated in FIG. 1 and described above. However, the actuator 132 and the receptacle 134 can be different from the actuator 32 and the receptacle 34.

A first end 136*a* of a removal hose 133 is connected to the actuator 132 and a second end 136*b* of the removal hose 133 is positioned in the insulation cavities 120. The removal hose 133 is the same as, or similar to, the removal hose 33 illustrated in FIG. 1 and described above. However, removal hose 133 can be different from the removal hose 33.

In operation, the actuator 132 is configured to convey the removed loosefill insulation material through the removal hose 133 in the direction indicated by arrow D101 and into the receptacle 134.

Referring again to FIG. 2, the receptacle 134 can include an optional compacting mechanism 148 and an optional air separation mechanism (not shown). The compacting mechanism 148 and the air separation mechanism can be the same as the compacting mechanism 48 illustrated in FIG. 1 and the air separation mechanism described above. Alternatively, the compacting mechanism 148 and the air separation mechanism can be different. The compacting mechanism 148 is configured to compress the withdrawn loosefill insulation material to facilitate storage, in the direction indicated by arrows D103, within the receptacle 134. As discussed above for the receptacle 34, the receptacle 134 can optionally include a packaging mechanism (not shown). The packaging mechanism can be configured to encapsulate the compressed withdrawn loosefill insulation material into a bag of compressed loosefill insulation 154. The bags 154 can exit the receptacle 134 in the direction as indicated by arrow D104.

Figure 3:
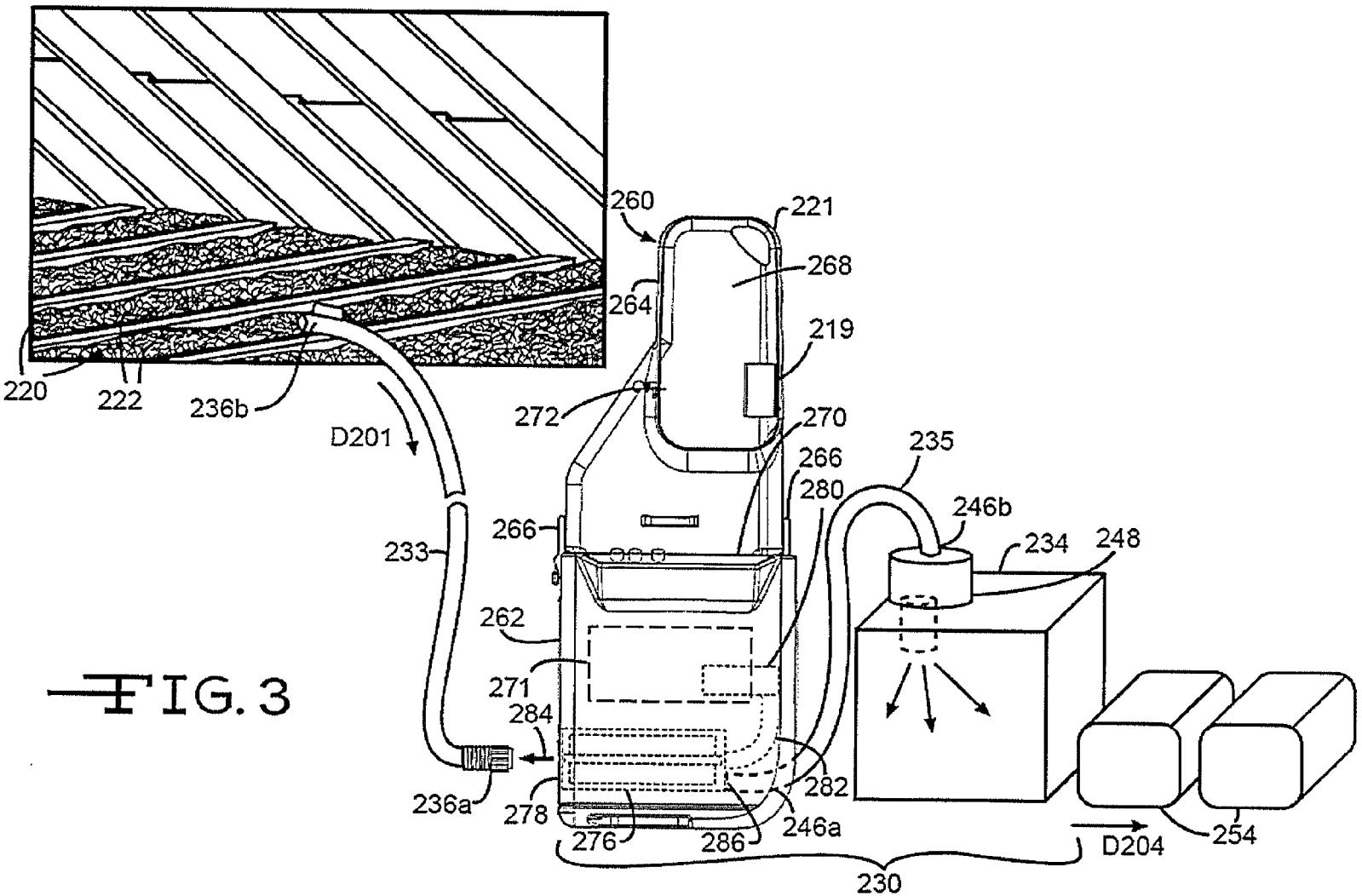
FIG. 3 is a schematic view of a third embodiment of an apparatus configured to facilitate removal of existing, previously-applied loosefill insulation material from insulation cavities of a building, the apparatus including a blowing wool machine.

In another embodiment, as shown in FIG. 3, an apparatus 230 is configured to remove loosefill insulation material 222 from a plurality of insulation cavities 220. The apparatus 230 includes a blowing wool machine 260 and at least one receptacle 234. In this embodiment, the blowing wool machine 260 is configured for distributing conditioned loosefill insulation material into the insulation cavities 220 and further configured for removal of the loosefill insulation material 222 from the insulation cavities 220.

The blowing wool machine 260 includes a lower unit 262 and a chute 264. The lower unit 262 can be connected to the chute 264 by a plurality of fastening mechanisms 266 configured to readily assemble and disassemble the chute 264 to the lower unit 262. The chute 264 has an inlet end 268 and an outlet end 270.

When the blowing wool machine 260 is configured for distribution of loosefill insulation material, the chute 264 is configured to receive loosefill insulation material from a source of loosefill insulation material and introduce the loosefill insulation material to a plurality of shredding mechanisms, shown schematically at 271, positioned in the lower unit 262. Optionally, the chute 264 includes a handle segment 221 to facilitate ready movement of the blowing wool machine 260 from one location to another. However, the handle segment 221 is not necessary to the operation of the blowing wool machine 260.

As further shown in FIG. 3, the chute 264 includes an optional guide assembly 219 mounted at the inlet end 268 of the chute 264. The guide assembly 219 is configured to urge a package of compressed loosefill insulation material against a cutting mechanism 272 as the package moves into the chute 264.

The plurality of shredding mechanisms 271 is mounted at the outlet end 270 of the chute 264. In the illustrated embodiment, the shredding mechanisms 271 include a plurality of low speed shredders and a high speed shredder. The low speed shredders are configured to shred and pick apart the loosefill insulation material as the loosefill insulation material is discharged from the outlet end 270 of the chute 264 into the lower unit 262. The high speed shredder is configured for additional shredding of the loosefill insulation material. While the illustrated embodiment is described as having a plurality of low speed shredders and a high speed shredder, it should be appreciated that any desired quantity and combination of low speed shredders and high speed shredders can be used. It should further be appreciated that any type, quantity and configuration of separator or shredder, such as a clump breaker, beater bar or any other mechanism that shreds and picks apart the loosefill insulation material can be used.

Referring again to FIG. 3, the shredding mechanisms can include shredders (not shown) configured to condition the loosefill insulation material prior to distribution of the loosefill insulation material into an airstream 284. The term "condition" as used herein, is defined as the shredding of the loosefill insulation material to a desired density prior to distribution into the airstream 284. The shredding mechanisms can be positioned within the lower unit 262 in any desired configuration relative to each other.

In the illustrated embodiment, the shredding mechanisms rotate at a speed in a range of from about 40 rpm to about 500 rpm. In other embodiments, the shredding mechanisms can be rotate at speeds less than about 40 or more than about 500 rpm.

Referring again to FIG. 3, a discharge mechanism 276 is positioned in the lower unit 262 downstream from the shredding mechanisms and is configured to distribute the conditioned loosefill insulation material into the airstream 284. In this embodiment, the conditioned loosefill insulation material is driven through the discharge mechanism 276 and through a first machine outlet 278 by an airstream provided by a blower 280 mounted in the lower unit 262. In other embodiments, the airstream 284 can be provided by another method, such as by a vacuum, sufficient to provide an airstream 284 driven through the discharge mechanism 276. In the illustrated embodiment, the blower 280 provides the airstream 284 to the discharge mechanism 276 through a duct 282. Alternatively, the airstream 284 can be provided to the discharge mechanism 276 by another structure, such as by a hose or pipe, sufficient to provide the discharge mechanism 276 with the airstream 284.

Referring again to FIG. 3, a first end 236*a* of a removal hose 233 is connected to the first machine outlet 278 and a second end 236*b* of the removal hose 233 is positioned in the insulation cavities 220.

When the blowing wool machine 260 is configured for distribution of loosefill insulation material, the chute 264 guides the loosefill insulation material to the shredding mechanisms positioned in the lower unit 262. The shredding mechanisms shred, picks apart and conditions the loosefill insulation material. The conditioned loosefill insulation material exits the shredding mechanisms and enters the discharge mechanism 276 for distribution into the airstream 284 provided by the blower 280. The airstream 284, with the conditioned loosefill insulation material, exits the machine 260 at the first machine outlet 278 and flows through the removal hose 233 toward the insulation cavity 220.

As shown in FIG. 3, the discharge mechanism 276 further includes a second machine outlet 286. A connector 235 has a first end 246*a* attached to the second machine outlet 286 and a second end 246*b* attached to a receptacle 234. In the illustrated embodiment, the connector 235 and the receptacle 234 are the same as or similar to the connector 35 and the receptacle 34 shown in FIG. 1 and discussed above. However, the connector 235 and the receptacle 234 can be different from the connector 35 and the receptacle 34.

When the blowing wool machine 260 is configured for removal of existing loosefill insulation material 222 from the insulation cavities 220, the blowing wool machine 260 is configured to generate a removal force, transmitted through the removal hose 233, to the loosefill insulation material 222 in the insulation cavities 220. The removal force is configured to withdraw the loosefill insulation material 222 from the insulation cavities 220 and convey, in the direction indicated by arrow D201, the withdrawn loosefill insulation material through the discharge mechanism 276 to the second machine outlet 286. From there, the removed loosefill insulation material is conveyed through the connector 235 to the receptacle 234. In one embodiment, the removal force generated by the blowing wool machine 260 is a pneumatic vacuum force. In other embodiments, the removal force can be other desired forms.

Referring again to FIG. 3, the receptacle 234 includes an optional compacting mechanism 248. The compacting mechanism 248 can be the same as the compacting mechanism 48 illustrated in FIG. 1 and described above. Alternatively, the compacting mechanism 248 can be different. As discussed above, the receptacle 234 can include an optional packaging mechanism (not shown) and an optional air separation mechanism (not shown). The packaging mechanism can be configured to encapsulate the compressed withdrawn loosefill insulation material into a bag of compressed loosefill insulation material 254. The air separation mechanism can be configured to separate or filter the withdrawn loosefill insulation material from the removal force. The bags 254 can exit the receptacle 234 in the direction as indicated by arrow D204.

The shredding mechanisms, discharge mechanism 276 and the blower 280 are mounted for rotation. They can be driven by any suitable means, such as by a motor (not shown), or other means sufficient to drive rotary equipment. Alternatively, the shredding mechanisms, discharge mechanism 276 and the blower 280 can be provided with its own motor. In the illustrated embodiment, the shredding mechanisms, discharge mechanism 276 and the blower 280 are configured to operate on a single 110 volt, 15 amp power source provided to the blowing wool machine 260. In other embodiments, the shredding mechanisms, discharge mechanism 276 and the blower 280 can be configured to operate on multiple 110 volt, 15 amp power lines or on a single 220 volt power source.

Figure 4:
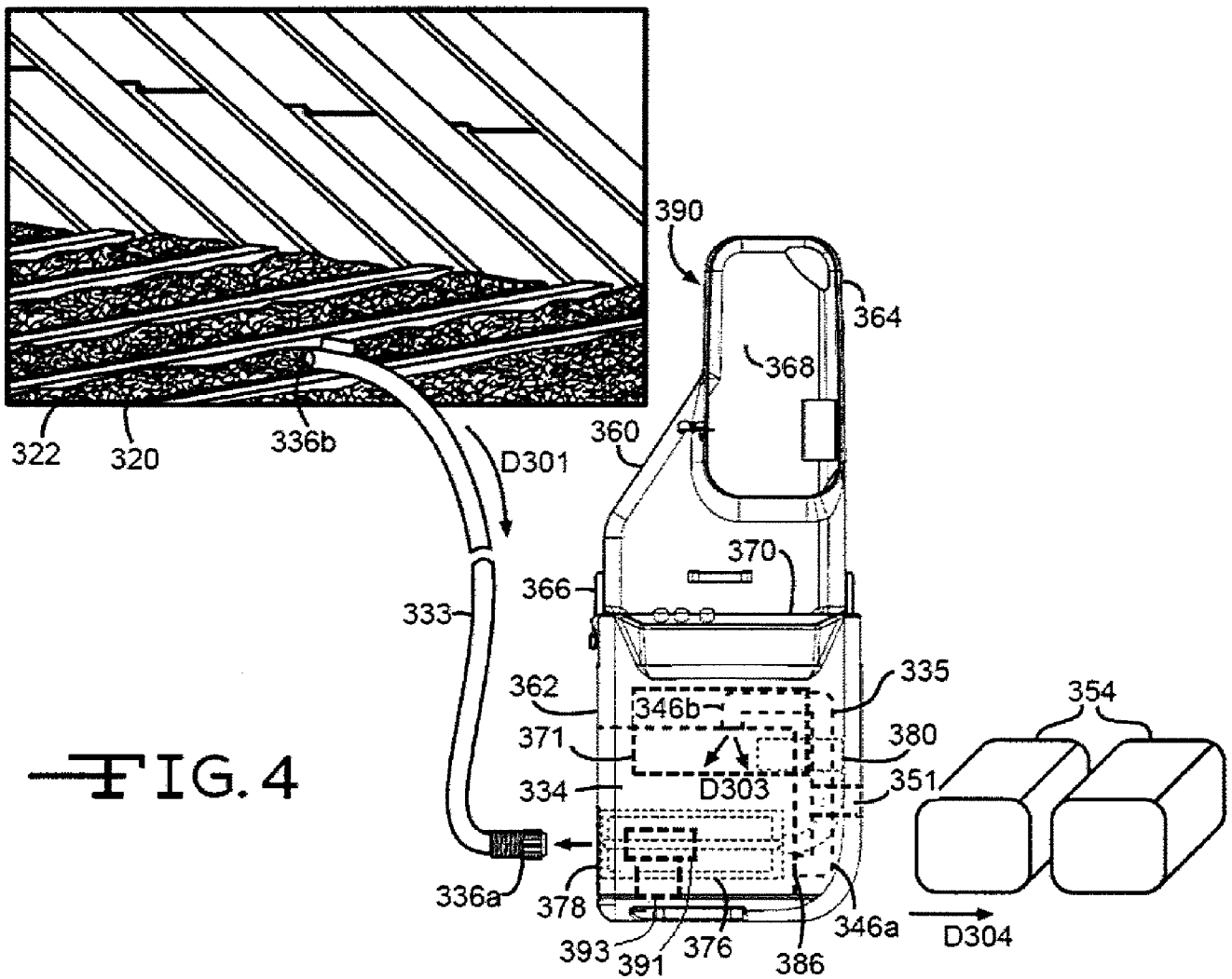
FIG. 4 is a schematic view of a fourth embodiment of an apparatus configured to facilitate removal of existing, previously-applied loosefill insulation material from insulation cavities of a building, the apparatus including a blowing wool machine.

While the apparatus 230, illustrated in FIG. 3 and discussed above, includes distinct components for the blowing wool machine 260 and the receptacle 234, other embodiments can combine the blowing wool machine 260 and the receptacle 234 into a single apparatus. Referring now to FIG. 4, an apparatus 390 is illustrated. The apparatus 390 incorporates a receptacle 334 into a lower unit 362 of the blowing wool machine 360. In the illustrated embodiment, the blowing wool machine 360 and the receptacle 334 are the same as, or similar to, the blowing wool machine 260 and the receptacle 234 illustrated in FIG. 3 and described above. However, the blowing wool machine 360 and the receptacle 334 can be different from the blowing wool machine 260 and the receptacle 234. The blowing wool machine 360 includes a chute 364 having an inlet end 368 and an outlet end 370. The lower unit 362 can be connected to the chute 364 by a plurality of fastening mechanisms 366 configured to readily assemble and disassemble the chute 364 to the lower unit 362. The lower unit 362 includes a plurality of shredding mechanism wn schematically at 371 and an actuator, shown schematically at 380.

A first end 336*a* of a removal hose 333 is connected to the first machine outlet 378 and a second end 336*b* of the removal hose 333 is positioned in insulation cavities 320. The removal hose 333 is the same as, or similar to, the removal hose 133 illustrated in FIG. 2 and described above. However, the removal hose 333 can be different from the removal hose 133.

When the apparatus 390 is configured for distribution of loosefill insulation material, the apparatus 390 operates the same as or similar to the operation of the blowing wool machine 260 illustrated in FIG. 3 and discussed above.

As shown in FIG. 4, a discharge mechanism 376 further includes a second machine outlet 386. A connector 335 has a first end 346*a* attached to the second machine outlet 386 and a second end 346*b* attached to the receptacle 334. In the illustrated embodiment, the connector 335 and the receptacle 334 are the same as or similar to the connector 35 and the receptacle 34 shown in FIG. 1 and discussed above. However, the connector 335 and the receptacle 334 can be different.

When the apparatus 390 is configured for removal of the existing loosefill insulation material 322 from the cavities 320, the apparatus 390 is configured to generate a removal force, transmitted through the removal hose 333, to the loosefill insulation material 322 in the insulation cavities 320. The removal force is configured to withdraw the loosefill insulation material 322 from the insulation cavities 320 and convey, in the direction indicated by arrow D301, the withdrawn loosefill insulation material through the discharge mechanism 376 to the second machine outlet 386. From there, the removed loosefill insulation material is conveyed through the connector 335 to the receptacle 334. In one embodiment, the removal force generated by the blowing wool machine 360 is a pneumatic vacuum force. In other embodiments, the removal force can be other desired forms.

Referring again to FIG. 4, the receptacle 334 optionally includes a compacting mechanism, shown schematically at 391. The compacting mechanism 391 can be the same as the compacting mechanism 48 illustrated in FIG. 1 and described above. Alternatively, the compacting mechanism 391 can be different. As discussed above, the receptacle 334 can include an optional packaging mechanism, shown schematically at 393, and an optional air separation mechanism, also shown schematically at 351. The packaging mechanism 393 can be configured to encapsulate the compressed withdrawn loosefill insulation material into a bag of compressed loosefill insulation 354. The air separation mechanism 351 can be configured to separate or filter the withdrawn loosefill insulation material from the removal force. The bags 354 can exit the receptacle 334 in the direction as indicated by arrow D304.

While the embodiments described above involve the removal of existing loosefill insulation material from building cavities, in other embodiments, the existing previously-applied insulation in the building cavity may be in the form of a batt. The term "batt", as used herein, is defined to mean an elongated blanket of fibrous insulation material. In some embodiments, the batt can be faced with a facing material. In the event it is desired to retrofit existing buildings previously insulated with batts of insulation with other insulation materials, such as for example spray foam insulation, it may be desirable to remove the existing previously-applied batts of insulation prior to the application of the spray foam insulation. In some instances, the existing batts of insulation may be discarded during the removal process. In other instances, it may be desired to reuse the batts of insulation while maintaining the insulation in the batt structure. In still other instances, it may be desired to reconfigure the removed batts of insulation as loosefill insulation material and reapply the loosefill insulation material into the building cavities after the application of the spray foam insulation.

Figure 5:
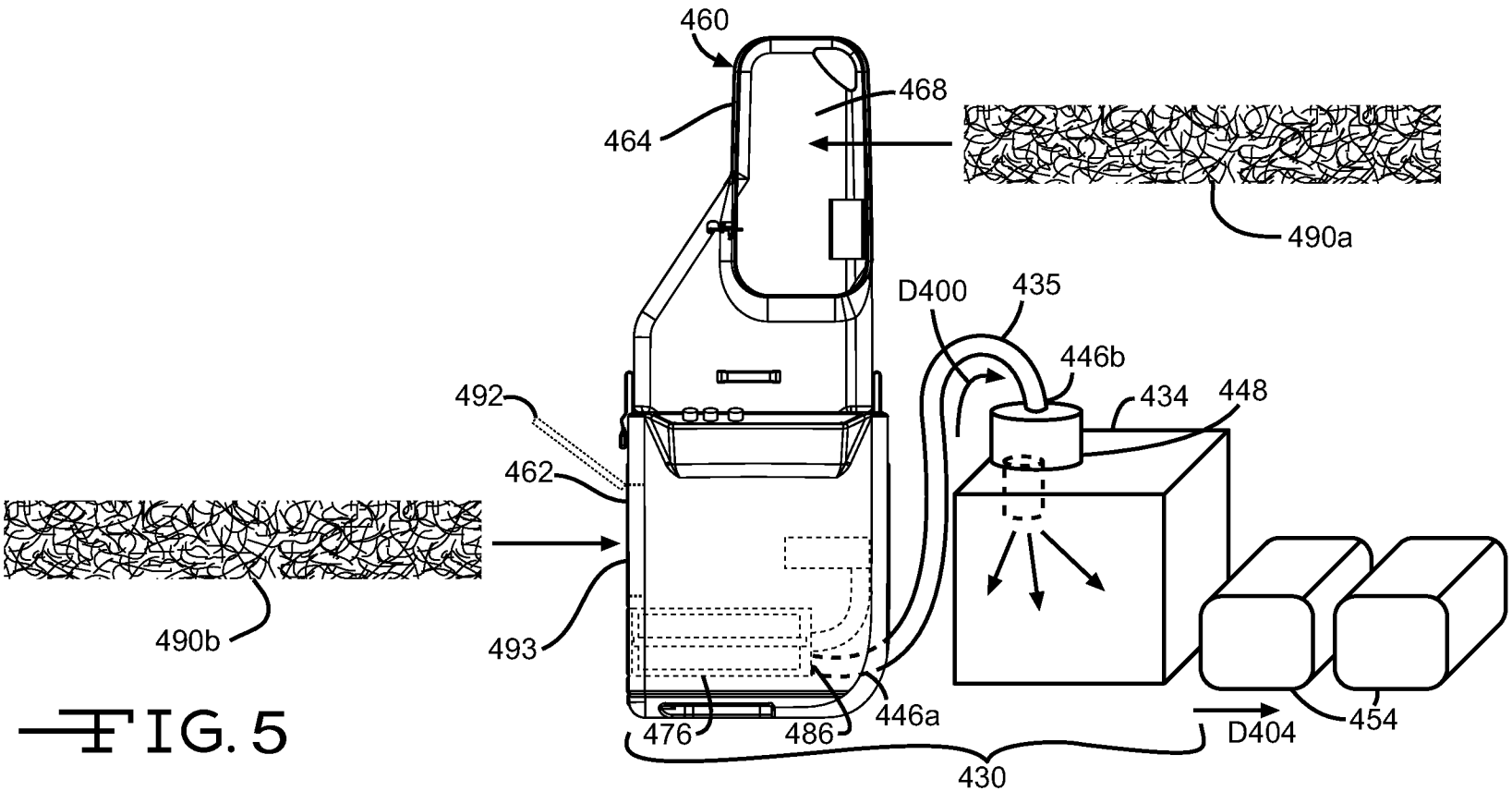
FIG. 5 is a schematic view of another embodiment of an apparatus configured to recondition existing, previously-applied insulation material from insulation cavities of a building, the apparatus including a separate blowing wool machine and receptacle.

Referring now to FIG. 5, an apparatus 430 is configured to recondition batts of insulation removed from building insulation cavities (not shown). The batts, 490*a* and 490*b*, can have any size, shape or configuration and can have a facing. The batts 490*a* and 490*b* can be removed from the building cavities by any desired method, including removal by hand. The apparatus 430 includes a blowing wool machine 460 and at least one receptacle 434. In this embodiment, the blowing wool machine 460 is configured for reconfiguring the batts 490*a* and 490*b* of insulation into loosefill insulation material and further configured to reapply the conditioned loosefill insulation material into insulation cavities.

The blowing wool machine 460 includes a lower unit 462 and a chute 464 having an inlet end 468. In the illustrated embodiment, the lower unit 462, chute 464 and inlet end 468 are the same as, or similar to the lower unit 262, chute 264 and inlet end 268 illustrated in FIG. 3 and described above. However, the lower unit 462, chute 464 and inlet end 468 can be different. The lower unit 462 includes a plurality of shredding mechanisms (not shown) and a discharge mechanism 476. The plurality of shredding mechanisms and the discharge mechanism 476 can be the same as, or similar to the shredding mechanisms and the discharge mechanism 276 for the blowing wool machine 260 as illustrated in FIG. 3 and as discussed above.

In one embodiment, the removed batts 490*a* are fed into the inlet end 468 of the chute 464. The batts 490*a* pass through the chute 464 and enter the shredding mechanisms for conditioning as loosefill insulation material. The shredding mechanisms shred, pick apart and condition the batts 490*a* into loosefill insulation material.

The conditioned loosefill insulation material exits the shredding mechanisms and enters the discharge mechanism 476. The discharge mechanism 476 includes a second machine outlet 486. A connector 435 has a first end 446*a* attached to the second machine outlet 486 and a second end 446*b* attached to a receptacle 434. In the illustrated embodiment, the connector 435 and the receptacle 434 are the same as or similar to the connector 35 and the receptacle 34 shown in FIG. 1 and discussed above. However, the connector 435 and the receptacle 434 can be different from the connector 35 and the receptacle 34. The conditioned loosefill insulation material is conveyed from the discharge mechanism 476 to the receptacle 434, in direction D400, as described above.

Referring again to FIG. 5, the receptacle 434 optionally includes a compacting mechanism 448. The compacting mechanism 448 can be the same as the compacting mechanism 48 illustrated in FIG. 1 and described above. Alternatively, the compacting mechanism 448 can be different. As discussed above, the receptacle 434 can include an optional packaging mechanism (not shown) and an optional air separation mechanism (not shown). The packaging mechanism can be configured to encapsulate the compressed withdrawn loosefill insulation material into a bag of compressed loosefill insulation 454. The air separation mechanism can be configured to separate or filter the conditioned loosefill insulation material from the conveyance force. The bags 454 can exit the receptacle 434 in the direction as indicated by arrow D404.

Referring again to FIG. 5, optionally, the lower unit 462 of the blowing wool machine 460 can include a pivotably mounted door 492 (shown in an open position). In the open position, the pivoting door 492 exposes an opening 493 in the lower unit 464. The opening 493 is configured to provide access to the shredding mechanisms positioned in the lower unit 462 of the blowing wool machine 460. In this embodiment, the removed batts 490*b* are fed through the opening 493, and into the shredding mechanisms for conditioning as loosefill insulation material. The shredding mechanisms shred, pick apart and condition the batts into loosefill insulation material. The conditioned loosefill insulation material exits the shredding mechanisms and enters the discharge mechanism 476 as discussed above.

Optionally, the opening 493 can be fitted with an extended chute (not shown) or other safety-related structures configured to provide for the protection of the machine operator. The safety-related structures can have any desired configuration.

When the blowing wool machine 460 is configured for distribution of the conditioned loosefill insulation material, the blowing wool machine 460 can operate as described above for the blowing wool machine 260 as illustrated in FIG. 3. Alternatively, the blowing wool machine 460 can be operated in other desired manners.

Figure 6:
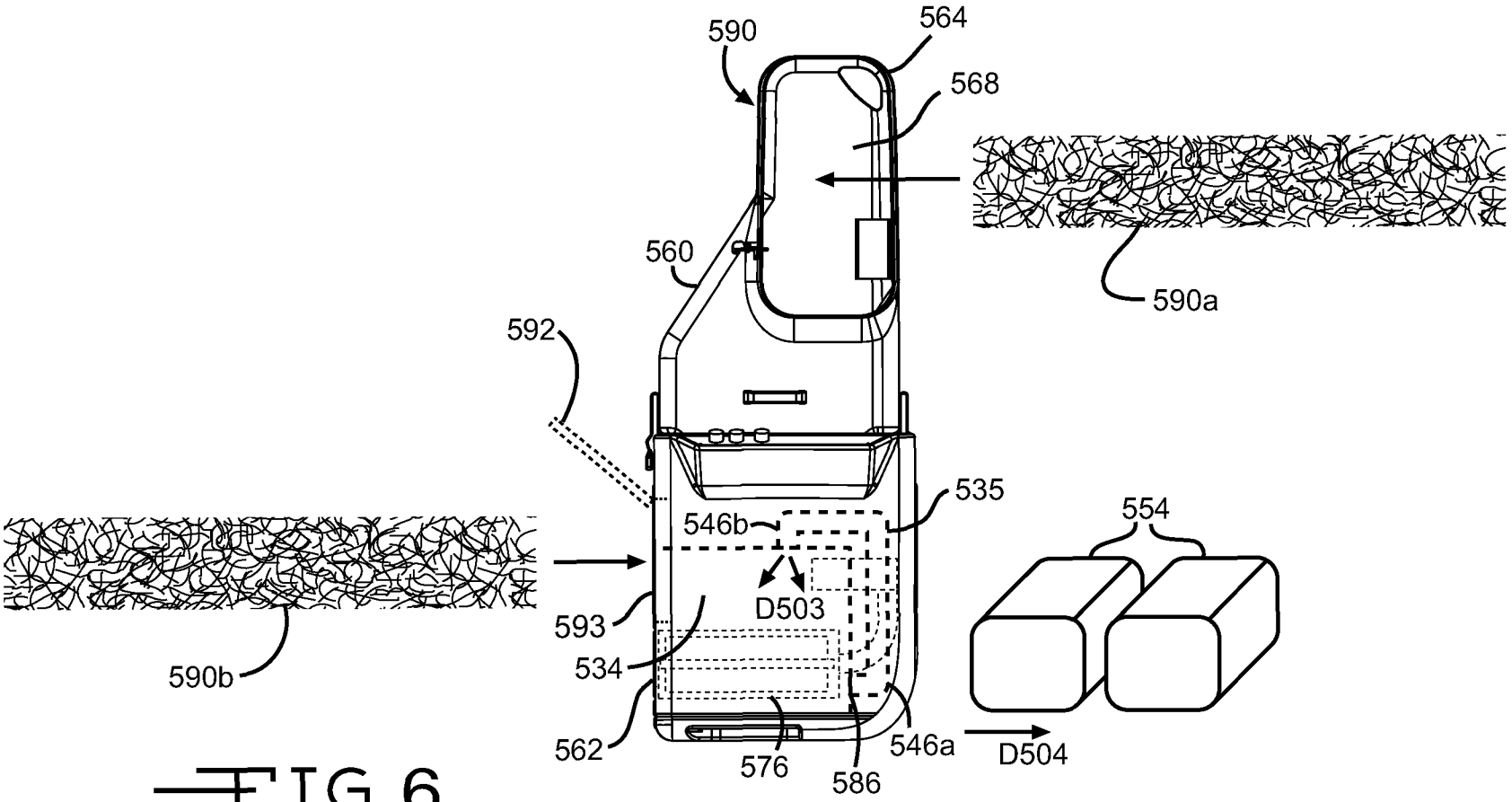
FIG. 6 is a schematic view of another embodiment of an apparatus configured to recondition existing, previously-applied insulation material from insulation cavities of a building, the apparatus including a receptacle incorporated into a blowing wool machine.

While the apparatus 430, illustrated in FIG. 5 and discussed above, includes distinct components for the blowing wool machine 460 and the receptacle 434, in other embodiments the blowing wool machine 460 and the receptacle 434 can be combined into a single apparatus. Referring now to FIG. 6, an apparatus 590 is illustrated. The apparatus 590 incorporates a receptacle 534 into a lower unit 562 of the blowing wool machine 560. The blowing wool machine 560 and the receptacle 534 are the same as, or similar to, the blowing wool machine 260 and the receptacle 234 illustrated in FIG. 3 and described above. However, the blowing wool machine 560 and the receptacle 534 can be different from the blowing wool machine 260 and the receptacle 234.

In one embodiment, removed batts 590*a* are fed through an inlet end 568 of a chute 564 and into the shredding mechanisms for conditioning as loosefill insulation material. The shredding mechanisms shred, pick apart and condition the batts 590*a* into loosefill insulation material. The conditioned loosefill insulation material exits the shredding mechanisms and enters the discharge mechanism 576.

As shown in FIG. 6, the discharge mechanism 576 includes a second machine outlet 586. A connector 535 has a first end 546*a* attached to the second machine outlet 586 and a second end 546*b* attached to the receptacle 534. In the illustrated embodiment, the connector 535 and the receptacle 534 are the same as, or similar to the connector 335 and the receptacle 334 shown in FIG. 4 and discussed above. However, the connector 535 and the receptacle 534 can be different.

Referring again to FIG. 6, optionally, the lower unit 562 of the blowing wool machine 560 can include a pivotably mounted door 592 (shown in an open position). In the open position, the pivoting door 592 exposes an opening 593 in the lower unit 562. The opening 593 is configured to provide access to the shredding mechanisms positioned in the lower unit 562 of the blowing wool machine 560. In this embodiment, the removed batts 590*b* are fed through the opening 593, and into the shredding mechanisms for conditioning as loosefill insulation material as discussed above for the blowing wool machine 460 illustrated in FIG. 5. The shredding mechanisms shred, pick apart and condition the batts into loosefill insulation material. The conditioned loosefill insulation material exits the shredding mechanisms and enters the discharge mechanism 576. Exiting the discharge mechanism 576, the conditioned loosefill insulation material is conveyed through the connector 535 to the receptacle 534 as discussed above.

Optionally, the opening 593 can be fitted with an extended chute (not shown) or other safety-related structures configured to provide for the protection of the machine operator. The safety-related structures can have any desired configuration.

The principle and mode of operation of the apparatus for removing loosefill insulation have been described in certain embodiments. However, it should be noted that the machine for removing loosefill insulation may be practiced otherwise than as specifically illustrated and described without departing from its scope.

What is claimed is:

1. An apparatus comprising:

a chute having an inlet end and an outlet end, the chute configured to receive loosefill insulation material;

a lower unit removably connected to the outlet end of the chute and positioned beneath the chute, the lower unit comprises an actuator, a receptacle and at least one shredding mechanism, wherein the actuator is connected to a removal hose and is configured to generate a removal force for removing loosefill insulation material from a building cavity, the receptacle is connected to the actuator and configured for storage of the removed loosefill insulation material, and the at least one shredding mechanism is configured to condition the removed loosefill insulation material for reuse as loosefill insulation material within the building cavity;

wherein the receptacle includes a compacting mechanism configured to compress the removed loosefill insulation material to a desired compression ratio.

2. The apparatus of claim 1, wherein the removal force is a vacuum.

3. The apparatus of claim 1, wherein the desired compression ratio ranges from about 5:1 to about 10:1.

4. The apparatus of claim 1, wherein the receptacle includes an air separation mechanism configured to separate the removed loosefill insulation material from the removal force.

5. The apparatus of claim 4, wherein the separation mechanism is a rotary valve.

6. The apparatus of claim 4, wherein the actuator and the shredding mechanisms are configured to operate on a single 110 volt, 15 amp power supply provided to the blowing wool machine.

7. The apparatus of claim 1, wherein the actuator and the receptacle are incorporated into a blowing wool machine.

8. A method of removing existing, previously-applied loosefill insulation material from a building cavity and reapplying the loosefill insulation material into the building cavity, the method comprising the steps of:

providing an apparatus configured to facilitate removal of existing, previously-applied loosefill insulation material from a building cavity, the apparatus includes a chute having an inlet end and an outlet end, the chute configured to receive loosefill insulation material, a lower unit removably connected to the outlet end of the chute and positioned beneath the chute, the lower unit comprises an actuator, a receptacle and at least one shredding mechanism, wherein the actuator is connected to a removal hose and is configured to generate a removal force for removing loosefill insulation material from a building cavity, the receptacle is connected to the actuator and configured for storage of the removed loosefill insulation material, and the at least one shredding mechanism is configured to condition the removed loosefill insulation material for reuse as loosefill insulation material within the building cavity;

withdrawing the existing, previously-applied loosefill insulation material through the removal hose of the apparatus;

compressing the withdrawn loosefill insulation material to a desired compression ratio with the apparatus;

configuring the withdrawn loosefill insulation material for reuse as loosefill insulation using the apparatus; and reapplying the withdrawn loosefill insulation material into the building cavity using the apparatus.

9. The method of claim 8, wherein the removal force is a vacuum.

10. The method of claim 8, including the step of separating the removed loosefill insulation material from the removal force with the apparatus, following the step of withdrawal of the existing, previously-applied loosefill insulation material through the removal hose of the apparatus.

11. The method of claim 8, wherein the actuator is a blowing wool machine.

12. An apparatus comprising:

a chute having an inlet end and an outlet end, the chute configured to receive loosefill insulation material;

a lower unit removably connected to the outlet end of the chute and positioned beneath the chute, the lower unit comprises an actuator, a receptacle and at least one shredding mechanism, wherein the actuator is connected to a removal hose and is configured to generate a removal force for removing loosefill insulation material from a building cavity, the receptacle is connected to the actuator and configured for storage of the removed loosefill insulation material, and the at least one shredding mechanism is configured to condition the removed loosefill insulation material for reuse as loosefill insulation material within the building cavity;

wherein the receptacle includes a packaging mechanism configured to encapsulate the removed loosefill insulation material into a bag.

13. The apparatus of claim 12, wherein the removal force is a vacuum.

14. The apparatus of claim 12, wherein the receptacle includes an air separation mechanism configured to separate the removed loosefill insulation material from the removal force.

15. The apparatus of claim 14, wherein the air separation mechanism is a rotary valve.

16. The apparatus of claim 12, wherein the actuator and the receptacle are incorporated into a blowing wool machine.

17. A method of removing existing, previously-applied loosefill insulation material from a building cavity and reapplying the loosefill insulation material into the building cavity, the method comprising the steps of:

providing an apparatus configured to facilitate removal of existing, previously-applied loosefill insulation material from a building cavity, the apparatus includes a chute having an inlet end and an outlet end, the chute configured to receive loosefill insulation material, a lower unit removably connected to the outlet end of the chute and positioned beneath the chute, the lower unit comprises an actuator, a receptacle and at least one shredding mechanism, wherein the actuator is connected to a removal hose and is configured to generate a removal force for removing loosefill insulation material from a building cavity, the receptacle is connected to the actuator and configured for storage of the removed loosefill insulation material, and the at least one shredding mechanism is configured to condition the removed loosefill insulation material for reuse as loosefill insulation material within the building cavity;

withdrawing the existing, previously-applied loosefill insulation material through the removal hose of the apparatus;

packaging the removed loosefill insulation material into a bag with the apparatus;

configuring the withdrawn loosefill insulation material for reuse as loosefill insulation using the apparatus; and reapplying the withdrawn loosefill insulation material into the building cavity using the apparatus.

* * * * *